US005799725A

United States Patent [19]

Bradley, Jr. et al.

[11] Patent Number: 5,799,725

[45] Date of Patent: *Sep. 1, 1998

[54] HEAT EXCHANGER COIL ASSEMBLY

[75] Inventors: Wilson E. Bradley, Jr., Ellicott City; Richard P. Merrill, Columbia; George R. Shriver, Sykesville; Robert S. Weinreich, Woodbine, all of Md.

[73] Assignee: Evapco International, Inc., Wilmington, Del.

[ * ] Notice: The term of this patent shall not extend beyond the expiration date of Pat. No. 5,425,414.

[21] Appl. No.: 442,861

[22] Filed: May 17, 1995

Related U.S. Application Data

[63] Continuation of Ser. No. 122,209, Sep. 17, 1993, Pat. No. 5,425,414.

[51] Int. Cl.[6] ..... F28D 1/04; F28F 1/32

[52] U.S. Cl. ..... 165/150; 165/151; 165/182

[58] Field of Search ..... 165/150, 151, 165/182

[56] References Cited

U.S. PATENT DOCUMENTS

| | | | |
|---|---|---|---|
| 1,284,578 | 11/1918 | Branzell | 165/172 |
| 1,992,646 | 2/1935 | Young | 165/182 |
| 2,006,649 | 7/1935 | Modine | 165/151 |
| 2,759,248 | 8/1956 | Burgess | 165/150 |
| 3,080,916 | 3/1963 | Collins | 165/150 X |
| 3,916,989 | 11/1975 | Harada et al. | 165/151 |
| 4,089,368 | 5/1978 | Bell, Jr. et al. | 165/150 X |
| 4,366,106 | 12/1982 | Benyak et al. | 165/182 X |

(List continued on next page.)

FOREIGN PATENT DOCUMENTS

| | | | |
|---|---|---|---|
| 464929 | 4/1914 | France . | |
| 458528 | 4/1928 | Germany . | |
| 1008691 | 5/1957 | Germany . | |
| 1551820 | 3/1970 | Germany . | |
| 2449145 | 4/1976 | Germany | 165/151 |
| 3413999 | 11/1985 | Germany . | |
| 3423746 | 1/1986 | Germany . | |
| 130998 | 8/1983 | Japan | 165/153 |
| 228893 | 11/1985 | Japan | 165/151 |
| 191892 | 8/1986 | Japan | 165/151 |
| 202093 | 9/1986 | Japan | 165/151 |
| 3183 | 1/1988 | Japan | 165/151 |
| 159597 | 6/1989 | Japan | 165/182 |
| 177364 | 5/1935 | Switzerland | 165/151 |
| 398110 | 9/1933 | United Kingdom | 165/151 |
| 513199 | 10/1939 | United Kingdom | 165/151 |
| 1311974 | 4/1973 | United Kingdom . | |

*Primary Examiner*—Leonard R. Leo

*Attorney, Agent, or Firm*—Panitch, Schwarze, Jacobs & Nadel, P.C.

[57] ABSTRACT

A coil assembly for use in a heat exchanger having air flowing in a predetermined direction. The coil assembly comprises a plurality of parallel linear tubes, a plurality of return tubes interconnecting the linear tubes, and a plurality of fins. Each linear tube has a central portion with an elliptical cross-section and two end portions with round female sockets having circular cross-sections. Each return tube has two end portions with circular cross-sections. Each end portion of a return tube fits into a round female socket of a linear tube regardless of the orientation of the major axes of the linear tubes. The major axis of the elliptical cross-section resides at an oblique angle with respect to the direction of air flow. Each fin comprises a planar sheet of a heat-conductive material with a plurality of holes. The central portion of a linear tube extends through each hole. Each fin securely contacts each linear tube extending therethrough such that heat transfer therebetween is enhanced. The linear tubes are oriented in a plurality of rows, each row forming a plane perpendicular with respect to the direction of air flow. The rows alternate such that the major axis of the elliptical cross-section of each linear tube in first alternating rows is oriented at a clockwise-rotated position, and the major axis of the elliptical cross-section of each linear tube in second alternating rows is oriented at a counter-clockwise-rotated position.

12 Claims, 5 Drawing Sheets

U.S. PATENT DOCUMENTS

| | | | |
|---|---|---|---|
| 4,411,309 | 10/1983 | Kunkel | 165/76 |
| 4,483,392 | 11/1984 | Korsmo et al. | 165/150 |
| 4,577,684 | 3/1986 | Hagemeister | 165/172 |
| 4,691,768 | 9/1987 | Obusu | 165/151 |
| 4,705,105 | 11/1987 | Cur | 165/151 |
| 4,723,599 | 2/1988 | Hanson | 165/151 |
| 4,755,331 | 7/1988 | Merrill et al. | 261/153 |
| 4,923,002 | 5/1990 | Haussmann | 165/151 |
| 5,092,397 | 3/1992 | Fuhrmann et al. | 165/151 |
| 5,117,905 | 6/1992 | Hesse | 165/182 |
| 5,168,923 | 12/1992 | Sacks | 165/151 |
| 5,318,112 | 6/1994 | Gopin | 165/151 |
| 5,425,414 | 6/1995 | Bradley, Jr. et al. | 165/150 |

HEAT EXCHANGER COIL ASSEMBLY

CROSS-REFERENCE TO RELATED APPLICATION

This is a continuation of application Ser. No. 08/122,209, filed Sep. 17, 1993, now U.S. Pat. No. 5,425,414, issued Jun. 20, 1995.

FIELD OF THE INVENTION

The present invention relates to a finned coil assembly for use in a heat exchanger. More particularly, the invention relates to such a coil assembly having a plurality of linear tubes with generally elliptical cross-sections and a plurality of return tubes, wherein the linear tubes extend through plate fins and are oriented in a unique geometry in order to maximize heat transfer between an internal heat exchange fluid running through the linear tubes and air that is flowing past the tubes. Moreover, the linear tubes and return tubes are constructed to interconnect with one another regardless of the angular rotation of the elliptical cross-section of any particular linear tube.

BACKGROUND OF THE INVENTION

Evaporators or plate-finned coil heat exchangers typically comprise a bundle of numerous lengths of pipe or tubing in a square or staggered array, with numerous plate fins slid over and cross-sectionally surrounding the tubes. The plate fins have holes punched in them to correspond to the tube array geometry. In the finished product, a fan or blower causes air to flow parallel with respect to the fins and perpendicular with respect to the tubes.

Usually, the fins have a formed collar at each hole that causes the tube extending therethrough to fit securely and snugly into the fin. The collar allows the fin to remain in good thermal contact with the tube, thereby providing good heat transfer into or out of the tube. Typically, the ends of the tubes are fitted with return bends to form at least one series of tubes. The ends of each series of tubes are fitted to inlet and outlet headers to complete the closure of the heat exchanger.

The tubes, bends, and fins are constructed of steel, copper, aluminum or other suitable metals and alloys. Typically, for steel construction, the tubes, bends, and fins are fabricated into a coil assembly, and then the coil assembly is hot dip galvanized. The galvanizing improves the corrosion resistance of the steel and also thermally and mechanically bonds the fin to the tube. For copper or aluminum construction, where galvanizing is not used, the tubes are expanded into tight contact with the fins. Such expansion is achieved by forcing an oversized mandrel through the individual tubes, or by hydraulically pressurizing the coil assembly.

Numerous factors enter into the geometry of the tube/fin arrays. The two most important factors are the efficiency of the heat transfer surface (the area in contact with the air flow) and the amount of resistance to air flow through the tube bundle (measured in terms of pressure drop).

The heat transfer process in the coil assembly involves numerous steps. First, a refrigerant or other heat exchange fluid is caused to boil or to condense on the inside surface of the tubes through well known methods. Boiling or condensing refrigerant flowing through tubes is a very turbulent, active and efficient mode of heat transfer. A typical heat transfer coefficient might be 400 BTU/hr-ft$^2$-degree F. (2270 W/m$^2$-K).

Next, the heat is conducted through the walls of tubes. The tube wall is relatively thin and the conductivity of most metals is known to be high. For 0.060 inch (1.5 mm) thick steel tube, the conduction coefficient would be around 5200 BTU/hr-ft$^2$-degree F. (29,500 W/m$^2$-K). Finally, the heat is transferred by conduction from the tube surface to the air. Due to the physical properties of air, the heat transfer coefficient from a bare tube to the air is around 15 BTU/hr-ft$^2$-degree F. (85 W/m$^2$-K).

Plainly, the final step in the transfer is the limiting factor, and the overall rate of heat transfer can never be greater than the outside coefficient. Thus, the external heat transfer coefficient must be improved in order to improve the overall heat transfer coefficient.

As is well known, the external heat transfer may be increased by moving the air past the tubes. The air must be turbulent enough to prevent streamline flow through the coil. That is to say, all the air going through the coil must come into contact with one or more of the tube surfaces for as long and as often as possible before leaving the coils. If air, due to the geometry of the tube bundle, is allowed to pass through the coil assembly without coming into contact with the tube (bypass air), then the effort expended (fan horsepower) to move the bypass air has been wasted.

As a way to improve coil bundle performance, more tubes can be added to the bundle. Thus, tube surface area is increased and bypass air is decreased. However, additional tube surface requires more expense. Also, the tubes require considerable space in the coil array. If too many tubes are stacked together too tightly, airflow will be restricted to the point that more fan horsepower is required. Moreover, and as a practical limitation on tube density, moving tubes closer together requires return bends with tight radii. Such return bends are not easily fabricated, and welding such return bends to the ends of the tubes is exceedingly difficult.

As is well known, the addition of fins to the coil assembly greatly increases the heat transfer area of the coil assembly and accordingly enhances the external heat transfer process. In particular, by increasing the external surface area of the coil assembly by a factor of 10, as is typical, much more area is in contact with the air stream. Although adding fins to the spaces between the tubes increases airflow resistance, the fins are very thin material (about 0.005 to 0.02 inch {0.13–0.5 mm} thick) and are aligned in a direction generally parallel with respect to the air flow. Thus, the benefit of the fins far outweighs the airflow resistance and fan horsepower penalties. Typically, the spacing between fins is from about 0.16 to 0.33 inch (about 4.1 to about 8.4 mm).

Fin efficiency is, at best, always somewhat less than the tube surface efficiency because the fin is physically (and thermally) extended from the refrigerant inside the tube. Adding a fin adds a fourth step to the heat transfer process described above, in that heat must first pass through the tube and then to the fin. Although the fin is very conductive, the thin material provides limited heat conduction. Thus, as the perimeter of the fin gets farther away from the tube, the efficiency of the fin decreases. However, the efficiency of the fin can be somewhat enhanced with ripples, wrinkles and bumps. These features improve the heat transfer from the surface of the metal to the air by increasing the fin surface area, increasing turbulence and reducing air bypass. However, these features also increase the pressure drop of the air, so that a tradeoff must be considered in addition to these features.

Since fin efficiency falls off with increasing radial distance from a tube, tube geometry and spacing becomes even more important. On the one hand, moving tubes closer together raises the efficiency of the fin surfaces in between the tubes. On the other hand, moving tubes closer together also increases tube density in the bundle. As previously stated, higher tube density requires higher fan horsepower due to the restricted air flow. Thus, within the limits of tube cost, manufacturing capabilities and air flow restrictions, the more tubes, the better for optimum coil efficiency.

The number of compromises and tradeoffs in finned coil design are numerous. All are aimed at maximizing the efficiency of the external heat transfer, minimizing air flow resistance and minimizing material costs.

Some of the existing designs in the art of heat exchanger coil assemblies are as follows:

Rectangular tube spacing: By arranging tubes in straight rows and columns, numerous advantages are obtained from the relative simplicity of the arrangement. However, such an arrangement allows for a relatively high amount of bypass air. Another problem arises in that, except for the air side tube, each tube in a column is directly in the "shadow" of another tube, and does not receive an adequate flow of air. As a result, the most important portions of the fins, which are closest to the tubes, are in the "shadows" and do not receive adequate air flow, either.

Triangular or staggered tube spacing: By arranging tubes in a triangular pattern, with transversely oriented rows of tubes staggered, the tubes can be much closer together while still maintaining a good open area percentage for airflow through the coil. In a typical equilateral spacing of 2.5 inches (63.5 mm) between tubes having 1 inch (25.4 mm) diameter, the open area at any row of the coil (1 row % open) is 60%. Also, the air passing through the coil is forced to go over and around each succeeding column of tubes. When a second staggered row is considered in the open area calculation, then the projected open area (2 row % open) nominally becomes only 20%. The nominal 20% open area number is effectively somewhat greater in that the air flow is not as linear as the projection. Regardless, the triangular pattern significantly reduces bypass air without causing high pressure drops, and although tubes are still "shadowed", the increased air turbulence provides better air flow to the "shadowed" spots.

Elliptical tubes: Theoretically, elliptical or compressed tubes offer much less resistance to air flow. Also, elliptical tubes in a bundle may be more tightly spaced while still maintaining a high percentage of open area through the coil. However, return bends connecting the tubes are greatly complicated by the elliptical cross-section to which each return bend must attach, as can be seen in U.S. Pat. No. 3,413,999 (to Thomae). Bending elliptical tubes is exceedingly difficult. As the Thomae patent shows, round tube bends with elliptically stamped ends are known. However, several different return bend configurations are required depending on the angular orientation of the elliptical tubes and the angle that a particular return bend must traverse. Moreover, the return bends of the Thomae patent are extremely limiting in terms of the possible tube geometries. Even more so, each elliptical end portion of the Thomae return tubes is exceedingly difficult to form and provides little room for error.

The present invention overcomes the numerous problems detailed above by providing a coil assembly using elliptical tubes oriented in a plurality of staggered rows, with the major axes of the ellipses alternately rotated from one row to the next at an angle that provides maximum efficiency.

Moreover, the present invention also overcomes the need in such an elliptical tube geometry for several different return bend configurations and provides a coil assembly requiring only one type of return bend. As a result, the configuration of the return bend used to interconnect any two linear tubes is not dependent upon the angle of rotation of the major axis of the ellipse of any of the tubes, nor is it dependent upon the angle that a particular return bend must traverse. Numerous other advantages of the present invention will be evident from the drawings and the description set forth below.

SUMMARY OF THE INVENTION

Briefly stated, the present invention comprises a coil assembly for use in a heat exchanger having air flowing in a predetermined direction, as well as a heat exchanger containing the novel coil assembly. The coil assembly comprises a plurality of linear tubes, a plurality of return tubes, and a plurality of plate fins.

Each linear tube has a longitudinal axis, a central portion and two end portions. The central portion has a generally elliptical cross-section with major and minor axes, and each of the two end portions has a generally circular cross-section. Each linear tube is oriented to be generally parallel with respect to every other linear tube, and to be generally transversely oriented with respect to a line in the direction of air flow. Additionally, each linear tube is oriented such that the major axis of the elliptical cross-section resides at an oblique angle with respect to a line in the direction of air flow.

Each return tube has a body portion and two end portions. The body portion comprises a bend of about 180 degrees and each of the two end portions has a generally circular cross-section. Each circular end portion is sized to engage a circular end portion of a linear tube such that a plurality of linear tubes are interconnected with another to is form at least one series of linear tubes. Each series of linear tubes has first and second ends for connecting, respectively, to an inlet source of an internal heat exchange fluid and to an outlet for the internal heat exchange fluid.

The plate fins are positioned adjacent one another. Each fin comprises a generally planar sheet of a heat-conductive material, and is oriented in a plane generally perpendicular with respect to the longitudinal axes of the linear tubes and generally parallel with respect to a line in the direction of air flow. The fin sheet has a plurality of holes, and the central portion of a linear tube extends through each hole. Each fin securely contacts each linear tube extending therethrough such that heat transfer therebetween is effectuated.

The heat exchanger containing the coil assembly also includes a housing, a fan or blower, and inlet and outlet manifolds respectively connected to the first and second ends of the linear tubes.

In a preferred embodiment, the linear tubes are oriented in a plurality of rows, each row forming a plane generally perpendicular with respect to a line in the direction of air flow. The rows alternate in a "rick-rack" fashion such that the major axis of the elliptical cross-section of each linear tube in first alternating rows is oriented in a clockwise-rotated position, and the major axis of the elliptical cross-section of each linear tube in second alternating rows is oriented in a counter-clockwise-rotated position.

BRIEF DESCRIPTION OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and is instrumentalities shown. In the drawings.

DETAILED DESCRIPTION OF PREFERRED EMBODIMENTS

Figure 1:
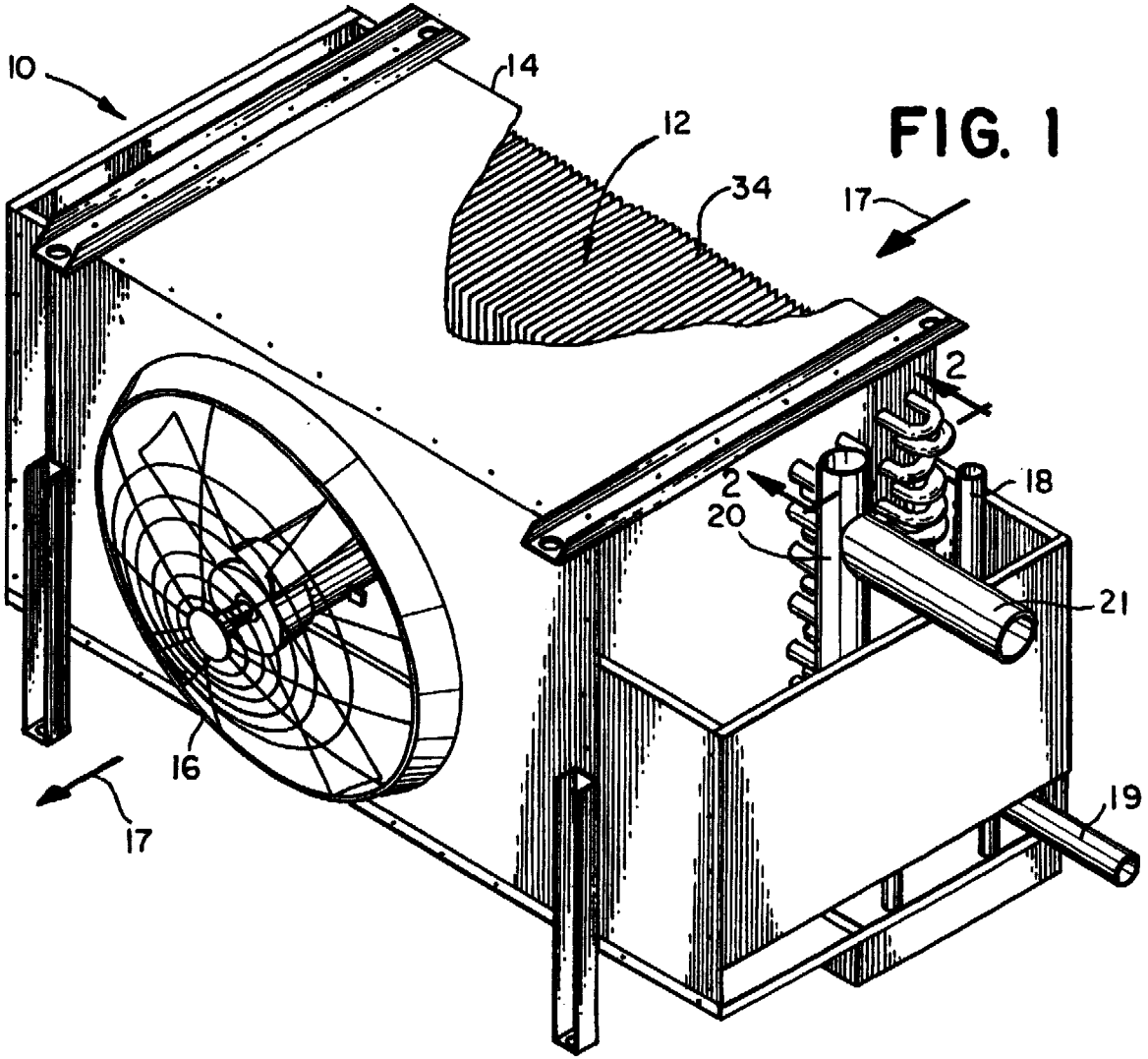
FIG. 1 is a perspective view showing a heat exchanger having a coil assembly constructed in accordance with the present invention, with a broken-away portion showing the fin structure of the coil assembly.

Certain terminology may be used in the following description for convenience only and is not limiting. The words "right", "left", "upper" and "lower" designate directions in the drawings to which reference is made. The words "inwardly" and "outwardly" refer to directions toward and away from, respectively, the geometric center of the referenced element. The terminology includes the words above specifically mentioned, derivatives thereof, and words of similar import.

Referring to the drawings in detail, wherein like numerals are used to indicate like elements throughout the several views, there is shown in FIG. 1 a heat exchanger 10 constructed in accordance with the present invention. The heat exchanger 10 has a coil assembly 12, a housing 14, and a fan or blower 16. As is shown, the coil assembly 12 is at least partially disposed within the housing 14, and the fan is arranged to move air by blowing or drawing air through the housing and across the coil assembly 12. In the drawings, arrows 17 indicate the direction of air flow being drawn through the heat exchanger, although it is understood that the air may also move in the opposite direction. The heat exchanger 10 also includes inlet and outlet manifolds 18, 20 with respective inlet and outlet pipes 19, 21. As is well known, an internal heat exchange fluid is circulated from an inlet source through the inlet pipe 19 and the inlet manifold 18, through the coil assembly 12, and then through the outlet manifold 20 and the outlet pipe 21 so that heat is exchanged between the internal heat exchange fluid in the coil assembly 12 and air that is drawn past the coil assembly 12 by the fan 16.

The internal heat exchange fluid used in the heat exchanger 10 may comprise air, water, coolant/refrigerant fluid, or any other heat exchange fluid. Preferably, a refrigerant fluid is used.

Figure 3A:
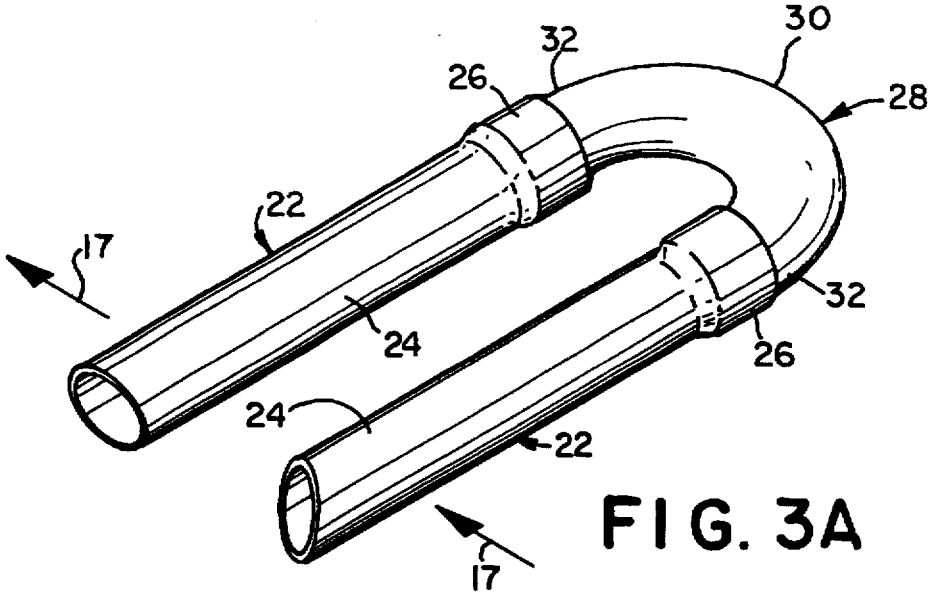
FIG. 3A is a perspective view showing a return tube interconnected to linear tubes, the linear tubes having their major axes oriented at oblique angles.
Figure 3B:
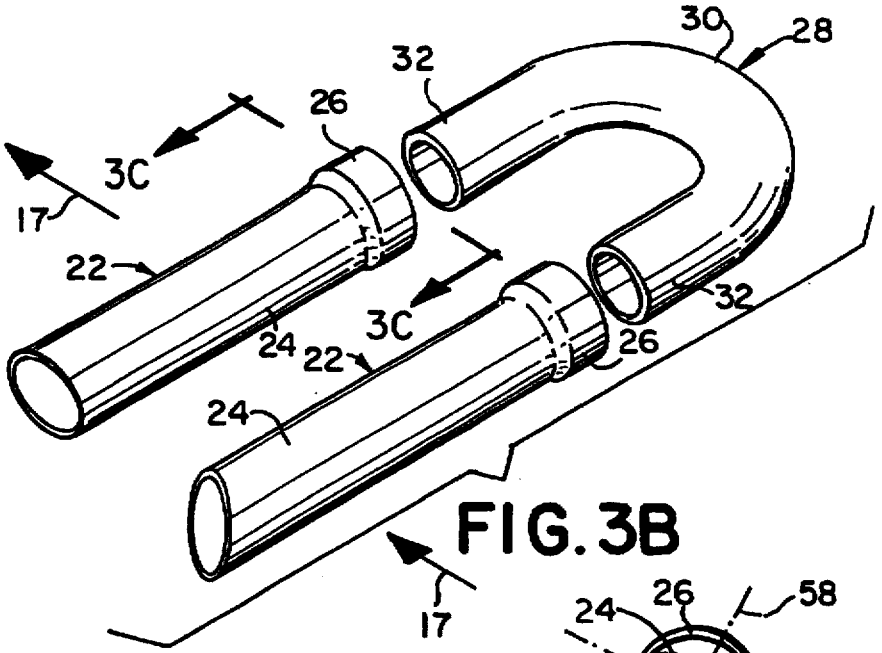
FIG. 3B is an exploded view of the return tube and linear tubes of FIG. 3A.
Figure 3C:
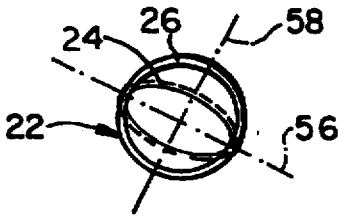
FIG. 3C is a cross-sectional view taken along line 3C—3C of FIG. 3B, and shows the elliptical central portion and the circular end portion of a linear tube.

The coil assembly 12 includes a plurality of linear tubes 22. As can be seen in FIGS. 3A–3C, each linear tube 22 has a longitudinal central portion 24 and two end portions 26 (only one end portion 26 of each tube 22 is shown in FIGS. 3A–3C). As can also be seen, the central portion 24 of each linear tube 22 has a generally elliptical cross-section with major and minor axes 56, 58. As can also be seen, each of the two end portions 26 on each linear tube 22 has a generally circular cross-section. Each linear tube 22 in the coil assembly 12 is oriented to be generally parallel with respect to every other linear tube 22, and is also oriented to be generally transversely oriented with respect to a line in the direction of air flow 17.

The linear tubes 22 are positioned within the housing 14 such that the fan 16 draws air across each linear tube 22. Moreover, and as may be seen in FIG. 2, each linear tube 22 is oriented in the housing 14 such that the major axis 56 of the elliptical central portion 24 of the linear tube 22 resides at an oblique angle with respect to a line in the direction of air flow 17.

Figure 2:
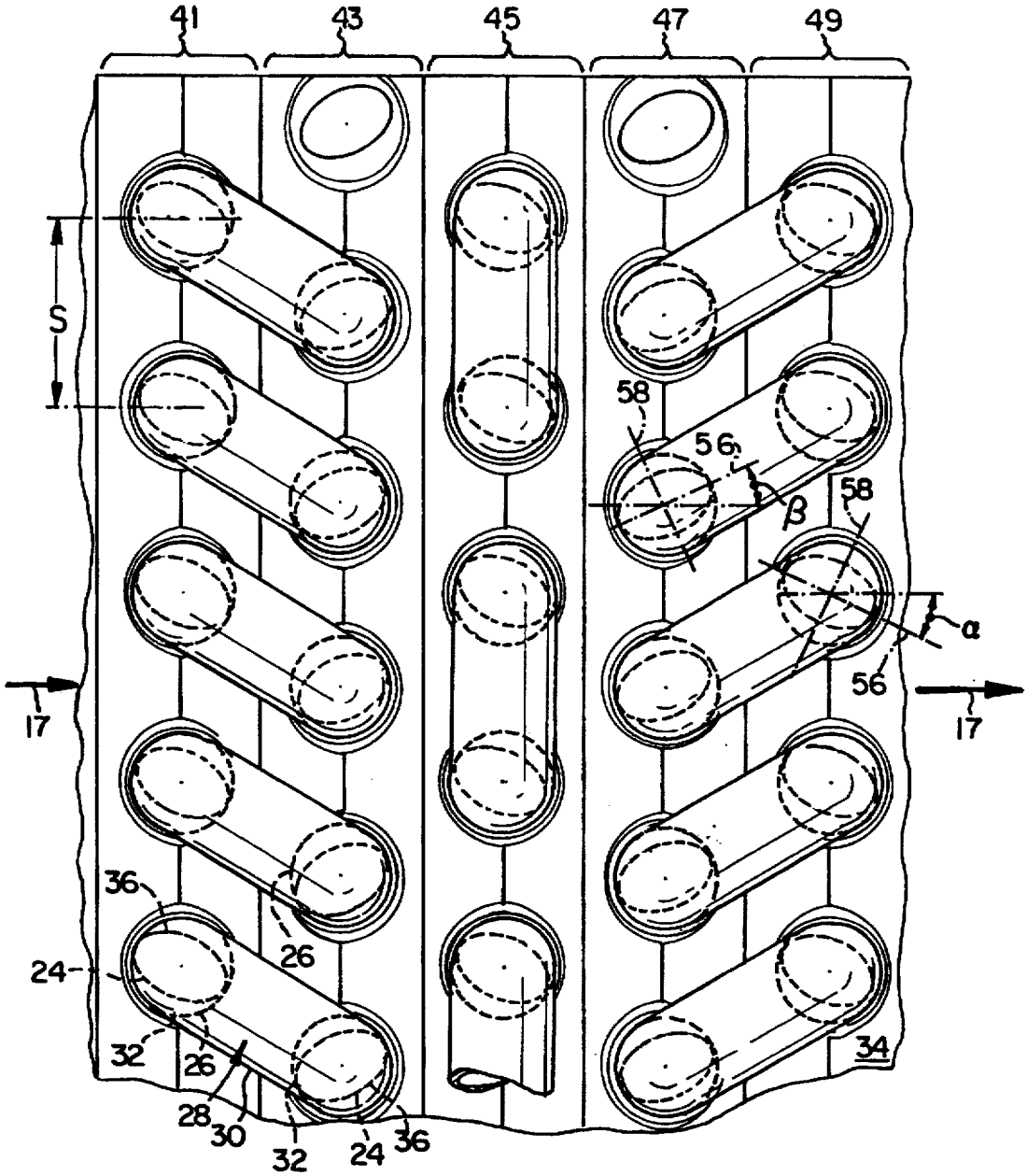
FIG. 2 is a partial side elevation view taken along line 2—2 of FIG. 1, with a side plate removed, and shows a plate fin with linear tubes extending therethrough and return tubes interconnecting adjacent linear tubes.

The coil assembly 12 of the heat exchanger 10 also has a plurality of return tubes, return bends, or bights 28. As best seen in FIGS. 2 and 3B, each return tube 28 has a body portion 30 and two end portions 32, with the body portion 30 comprising a bend in the tube of about 180 degrees and the two end portions 32 each having a generally circular cross-section. Thus, the circular end portions 32 of a return tube 28 may engage the circular end portions of any two linear tubes 22, regardless of the angle with respect to a line in the direction of air flow of the major axis 56 of either linear tube 22.

As also seen in FIG. 3B, in the presently preferred embodiment each end portion 26 of each linear tube 22 comprises a round female socket formed to be circular in cross-section. To form each round female socket, a simple swaging tool can be hydraulically forced or hammer driven into the end portion 26. The formation of the round female socket is not a delicate or precision operation, since the socket is simply a slightly oversized, round socket into which the round end portion 32 of a return tube 28 can fit. Through either method of formation, reliable alignment of the linear tubes 22 for welding may be achieved. Thus, the round end portion 32 of any return tube 28 can fit into the round end portion 26 of the linear tube 22, with the linear tube 22 oriented at any angle with respect to the major axis 56. As a result, one bend may be used to make any tube-to-tube connection.

With the round female socket as described and shown at either end portion 26 of each linear tube 22, the welding of the return tubes 28 to the linear tubes 22 is an easier operation. However, if desired, a round female socket may instead be formed on each round end portion 32 of each return tube 28, and the round end portion 26 of any linear tube 22 could fit into the round female socket, while still maintaining the aforementioned benefits of general universal alignment. Also, in some instances, it may also be easier to form round female sockets on the end portions 32 of the return tubes 28 by mass production.

A plurality of linear tubes 22 may be interconnected with the return tubes 28 to form one or more series of linear tubes 22. Each series of linear tubes may then be interconnected at a first end to the inlet manifold 18 and at a second end to the outlet manifold 20 such that the internal heat exchange fluid may be circulated through the coil assembly 12.

As shown in FIG. 1, the coil assembly 12 also includes a plurality of fins 34. The fins 34 are disposed within the housing 14, positioned adjacent one another. Each fin 34 surrounds the central portions 24 of a plurality of linear tubes 22 extending through the fins 34, and each fin 34 comprises a generally planar sheet of a heat-conductive material. Such heat-conductive materials include sheet steel and sheet aluminum, although one skilled in the art will recognize that any other heat-conductive material, such as copper, for example, may be used. Within the housing 14, each fin 34 is oriented to be in a plane that is generally perpendicular with respect to the longitudinal axes of the linear tubes 22 passing through the fin 34. As a result, the fins 34 are also generally parallel with respect to a line in the direction of air flow 17. Thus, the blowing air contacts each fin 34 but is relatively unimpeded thereby.

Figure 4B:
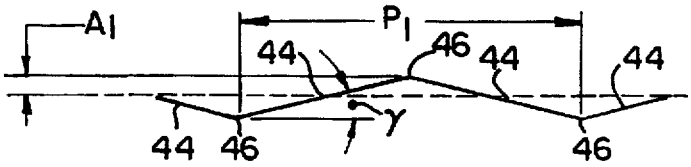
FIGS. 4B and 4C are partial cross-sectional side elevation views taken along lines 4B—4B and 4C—4C, respectively, of FIG. 4 and show the major and minor corrugations, respectively, of the plate fin.
Figure 4:
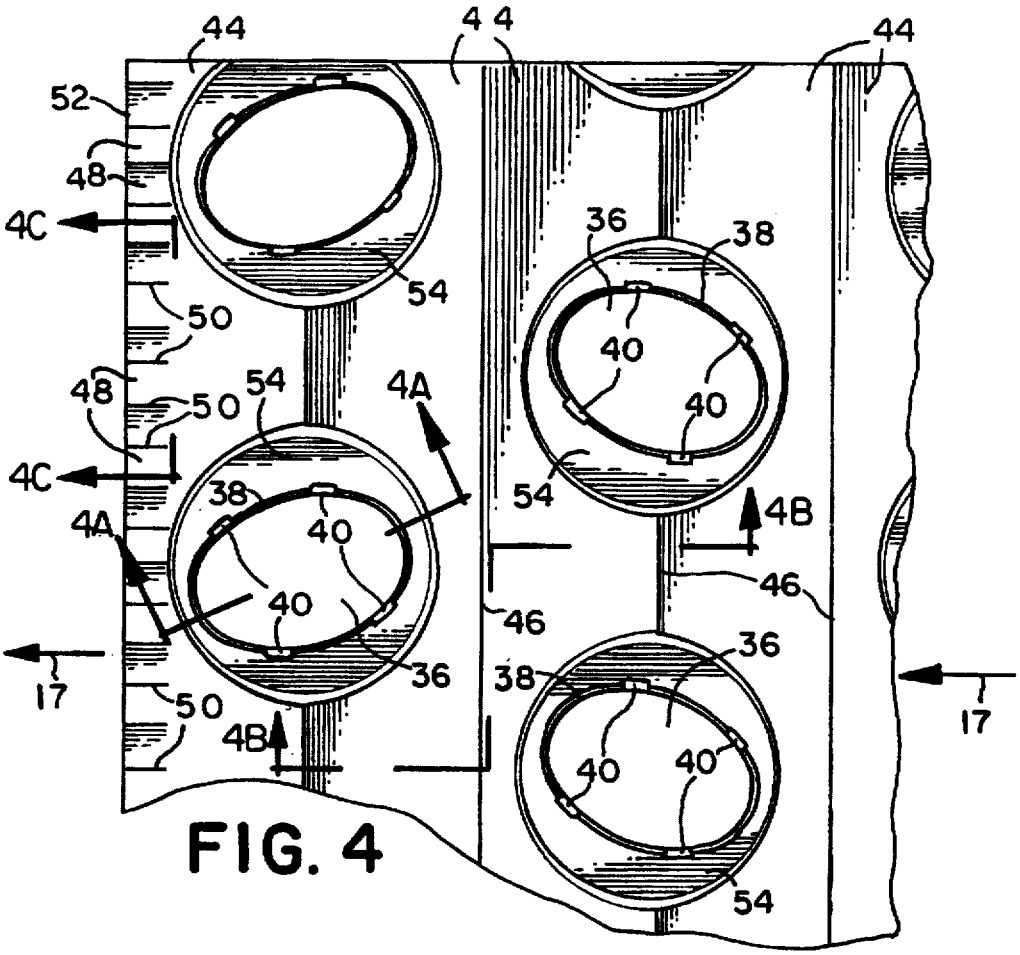
FIG. 4 is a front elevation view of a portion of a plate fin constructed in accordance with the present invention.
Figure 4C:
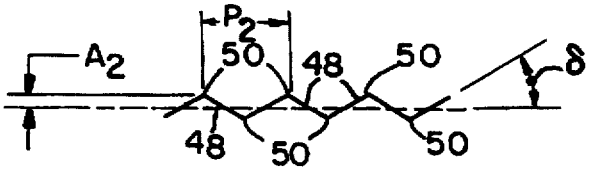
Figure 4A:
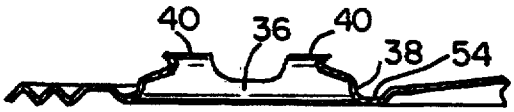
FIG. 4A is a partial cross-sectional view taken along line 4A—4A of FIG. 4, and shows the structure of the fin plate surrounding a hole in the plate fin.

As best shown in FIG. 4A, each fin sheet has a plurality of holes 36 through which the linear tubes 22 extend. Each hole 36 corresponds in outline to the angular orientation of the central portion 24 of the particular linear tube 22 extending through the hole 36.

To effectuate heat transfer between a fin 34 and each linear tube 22 extending through, the fin 34 should securely contact each linear tube 22. To that end, each hole 36 has a collar 38 around the perimeter of the hole 36 and extending from the sheet of the fin 34 in a direction generally perpendicular with respect to the plane of the fin sheet. Thus, each collar 38 securely engages the linear tube 22 extending through the collar 38 such that the surface area of engagement between the linear tube 22 and the fin 34 is enhanced, and the heat transfer between the linear tube 22 and the fin 34 is likewise enhanced.

Additionally, the collars 38 provide a degree of structural stiffness when the fin 34 is mounted on the linear tubes 22. As a result, the collars 38 maintain each fin 34 in alignment with respect to every other fin 34. The collars 38 also function to set the spacing between adjacent fins 34.

In addition to the collars 38, each fin 34 has spacing tabs 40 projecting from the collars 38. Specifically, and as best shown in FIGS. 4 and 4A, each spacing tab 40 extends in a direction generally parallel with respect to the plane of the fin sheet and away from the fin hole 36. Each spacing tab 40 extending from one face of a first fin 34 thus positively contacts the opposite face of the next adjacent fin 34. Through the contact, the first fin 34 is positively spaced from the adjacent fin 34, and the first fin 34 is prevented from telescoping or otherwise moving into contact with the next fin 34. The spacing between adjacent fins 34 may be varied by varying the height of each collar 38. Preferably, the collars 38 should space each fin 34 about 0.16 to about 0.33 inch (about 4.1 to about 8.4 mm) apart.

As should now be evident, each spacing tab 40 need not necessarily extend from a collar 38. Instead, a spacing tab 40 may extend directly from the perimeter of a fin hole 36 in a direction generally perpendicular with respect to the plane of the fin sheet, and then generally parallel with respect to the plane of the fin sheet and away from the fin hole 36.

As can best be seen in FIGS. 4 and 4B, each fin 34 preferably comprises a plurality of major corrugations 44. The major corrugations 44 have an amplitude $A_1$ and a period $P_1$. The major corrugations 44 are defined by a plurality of generally parallel alternating major folds or fold portions 46 across each fin 34, each major fold 46 protruding in the opposite direction as the next adjacent major fold 46 on either side. Preferably, the major folds 46 provide the major corrugations 44 with a small amplitude $A_1$ relative to the period $P_1$, such that the major corrugations 44 resemble a wave. Preferably, each major fold 46 is generally transversely oriented with respect to a line in the direction of air flow. As a result, a favorable, slight turbulence is created in the air blowing past each fin 34.

Also preferably, each fin 34 also comprises a plurality of minor corrugations 48. As with the major corrugations 44, the minor corrugations 48 have an amplitude $A_2$ and a period $P_2$. The minor corrugations 48 are defined by a plurality of generally parallel alternating minor folds or fold portions 50 across each fin 34, each minor fold 50 protruding in the opposite direction as the next adjacent minor fold 50 on either side. Preferably, the minor folds 50 provide the minor corrugations 48 with a small amplitude $A_2$ relative to the period $P_2$, such that the minor corrugations 48 resemble a ripple. Preferably, the minor corrugations 48 are oriented along at least a portion of at least one edge strip 52 of the fin 34, the edge strip 52 being generally transversely oriented with respect to a line in the direction of air flow. Also preferably, each minor fold 50 on the edge strip 52 is generally perpendicularly oriented with respect to the edge strip 52. More preferably, the minor corrugations 48 are oriented along the edge of each fin 34 that is directly exposed to the blowing air, and along the edge of each fin 34 opposite the edge that is directly exposed to the blowing air.

In a preferred embodiment of the fins 34, the ratio of the period of the major corrugations to the period of the minor corrugations is about 4.33:1, the period of the major corrugations is about 2 inches (51 mm), the period of the minor corrugations is about 0.475 inch (12.1 mm), the amplitude of both the major and the minor corrugations is about 0.03 inch (0.76 mm), the angle $\gamma$ of the major corrugations with respect to the plane of the fin sheet is about 3.5 degrees, and the angle $\delta$ of the minor corrugations with respect to the plane of the fin sheet is about 15 degrees.

Preferably, and as shown in FIGS. 4 and 4A, a planar area 54 surrounds each hole 36 on each fin 34. The planar areas 54 provide additional structural support and integrity to the fin 34, and provide an even surface from which the collar 38 and/or the spacing tabs 40 extend.

Referring now to FIG. 2, it is preferable that the holes 36 in each fin 34 and the linear tubes 22 extending through the holes 36 are oriented in a plurality of rows 41, 43, 45, 47, and 49, for example. More preferably, each row 41, 43, 45, 47, and 49 of holes 36 is oriented such that a major fold 46 intersects the centers of the holes 36 in each row. In each row, the linear tubes 22 preferably reside in a plane that intersects the longitudinal axes of the linear tubes 22. Also preferably, the plane is generally perpendicularly oriented with respect to a line in the direction of air flow 17.

Figure 5:
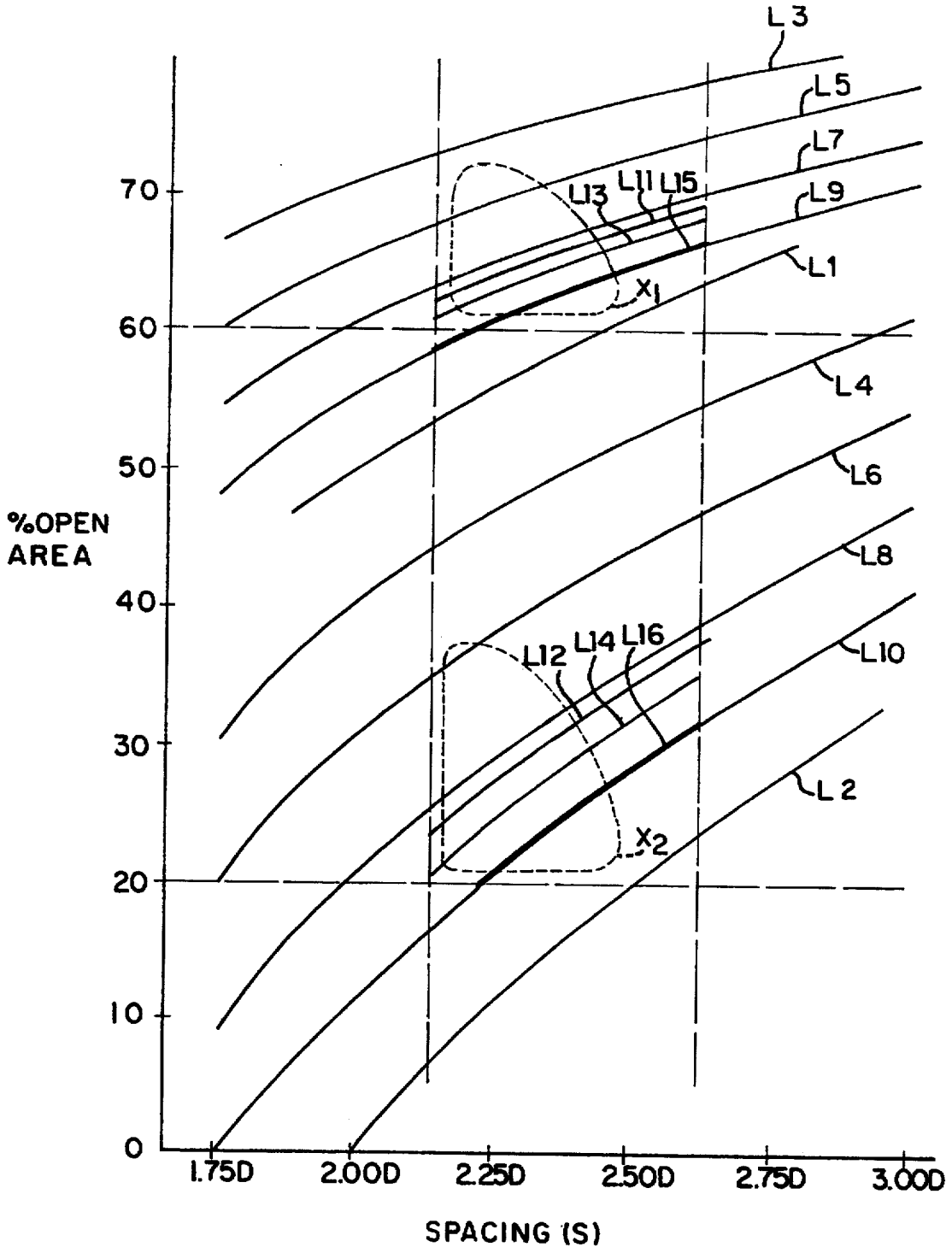
FIG. 5 shows a graph depicting the percentage of open area as compared to linear tube spacing for several geometries, the linear tube spacing expressed in terms of a tube diameter.

FIG. 5 shows a graph that represents the preferred orientation of the major axes 56 of the linear tubes 22 and the spacing and orientation of the linear tubes 22 in the coil assembly 12. The details of such geometry will be explained hereinafter.

For purposes of explanation, the generally elliptical cross-section of the central portion 24 of each linear tube 22, as shown in FIG. 2, will be discussed with reference to a like linear tube, except that the like linear tube has a central portion with a generally circular cross-section. The circumference of the central portion of such like tube with a circular cross-section is equal to the circumference of the elliptical cross-section of the central portion 24 of linear tube 22. Also for purposes of explanation, the arrow 17 in the direction of air flow has been reversed in FIG. 2 so that a first row 41 is seen by the air flow. The percentage of open area of the first row 41 of the tubes as seen by the flowing air (1 row % open) is equal to:

$$(S-D)\times 100/S$$

wherein S is the spacing between the centers of adjacent linear tubes and D is the diameter of the circular cross-section of each linear tube. Correspondingly, the percentage of open area of first and second rows 41 and 43 as seen by the flowing air (2 row % open) is equal to:

$$(S-2D)\times 100/S$$

wherein S and D are as described above. As S varies with respect to D, the 1 row % open and 2 row % open are computed as follows:

TABLE 1

| S | 1 Row % Open | 2 Row % Open |
|---|---|---|
| 2D | 50% | 0% |
| 2.25D | 56 | 11 |
| 2.5D | 60 | 20 |
| 2.75D | 64 | 27 |
| 3D | 67 | 33 |
| 3.25D | 69 | 38 |

The above computations are represented on the graph in FIG. 5., with line L1 representing 1 row % open and line L2 representing 2 row % open. The y-axis represents percent open area and the x-axis represents the spacing between tubes expressed in terms of tube diameter (D).

Referring again to FIG. 5, there are a number of preferred limits on the orientation and spacing of the tubes. First, in order to have improved air flow past the linear tubes 22, it is preferred that the 1 row % open be greater than 60%, and that the 2 row % open be greater than 20%. Second, as a practical matter, it is rather difficult to bend, weld, and otherwise work with linear and return tubing spaced closer than a certain distance. Thus, the preferred minimum spacing of the linear tubes is about 2.125 D. Third, it has been discovered that spacing the tubes beyond about 2.5 D to 2.625 D is inefficient, since the tubes are too far apart and fan horsepower is being wasted on air which bypasses the tube surfaces. Fourth, and generally, smaller diameter tubes are better than larger diameter tubes since more smaller diameter tubes can fit in the same space, and since the internal heat transfer fluid, typically coolant, in a smaller diameter tube is more closely associated with the tube walls. However, the smaller diameter tubes must be balanced with the increased pressure within the tubes and the effect of the pressure on the pumps used to circulate the internal heat transfer fluid. As a result, preferable linear tube geometries, orientations, and spacings within the coil assembly are generally in the areas marked X1 and X2 on FIG. 5, where it is expected that the coil assembly will be most efficient. Of course, a coil assembly 12 and/or heat exchanger 10 falling outside areas X1 or X2 may still have an improved efficiency compared to other prior art arrangements.

As shown by lines L1 and L2, round tubes would have to be spaced too far apart in order to have the proper 1 and 2 row % open areas required. Thus, it is necessary to have smaller spacing between tubes and larger open areas. This can be done by compressing the round tubes into ellipses, with the major axes of the ellipses oriented generally in the direction of air flow. Thus, the 1 row % open are would be $$(S-CD)\times 100/S,$$

and the 2 row % open area would be $$(S-2CD)\times 100/S,$$

with C being a compression factor in terms of the original diameter (D). The compression factor C can be expressed as a decimal, e.g. 0.8 D, or as a percentage, e.g. 80% D with respect to a tube having a central portion with a generally circular cross-section of the same circumference. As shown in Table 2, and as drawn in FIG. 5, the smaller the minor axis becomes with respect to the original diameter (D), the larger the 1 and 2 row % open areas become.

TABLE 2

| | .6D | | .7D | | .8D | | .9D | |
|---|---|---|---|---|---|---|---|---|
| S | 1R % | 2R % | 1R % | 2R % | 1R % | 2R % | 1R % | 2R % |
| 1.75D | 66% | 31% | 60% | 20% | 54% | 9% | 49% | 0% |
| 2D | 70 | 40 | 65 | 30 | 60 | 20 | 54 | 10 |
| 2.25D | 73 | 47 | 69 | 38 | 64 | 29 | 60 | 20 |
| 2.5D | 76 | 52 | 72 | 44 | 68 | 36 | 64 | 28 |
| 2.75D | 78 | 56 | 75 | 49 | 71 | 42 | 67 | 35 |
| 3D | 80 | 60 | 77 | 53 | 73 | 47 | 70 | 40 |
| LINE | L3 | L4 | L5 | L6 | L7 | L8 | L9 | L10 |

As can be seen from FIG. 5, the 0.7 D, 0.8 D and 0.9 D ellipses go through the preferred areas X1 and X2, to some extent.

When compared to theoretically predicted results, a coil assembly constructed with 0.8 D ellipses at a 2.25 D spacing is surprisingly not as efficient as expected. The thermal performance of a coil assembly using elliptical tubes was tested and was found to be not as much of an improvement as expected compared to a coil assembly using tubes having entirely round cross-sections, in spite of the improved air flow. Apparently, despite the greater air flow around the tubes, the streamlined shapes and positions of the ellipses cause the air to bypass some of the tubes in the coil without coming into good thermal contact with the tubes.

In an effort to overcome the problem of air bypass, the major axes of the ellipses may be rotated, thus redirecting the air to succeeding rows and preventing bypass through the coils. However, as the angle of the major axes of the ellipses is increased with respect to a line in the direction of air flow, the greater projected height of each tube with respect to the air flow direction causes the 1 and 2 row % open areas to decrease, as shown in Table 3.

TABLE 3

| | 0.8D @ 10° | | 0.8D @ 20° | | 0.8D @ 30° | |
|---|---|---|---|---|---|---|
| S | 1R % | 2R % | 1R % | 2R % | 1R % | 2R % |
| 2D | 59% | 18% | 57% | 14% | 55% | 10% |
| 2.25D | 63 | 27 | 62 | 24 | 60 | 20 |
| 2.5D | 67 | 34 | 66 | 31 | 64 | 28 |
| LINE | L11 | L12 | L13 | L14 | L15 | L16 |

Even more surprisingly, although tilting does reduce the one and two row percentage open areas, the pressure drop did not increase to the magnitude expected from similar percentage open area round tube arrays. Moreover, the resulting increase in air flow turbulence caused an unexpected improvement in the heat exchange rate between the air and the internal heat exchange fluid, as will be described below.

Empirically, it has been determined that a broad variety of elliptical compressions and tilt angles are available in the preferred areas X1 and X2 of the graph of FIG. 5. For example, a 0.7 D ellipse at a tilt angle of about 30 to about 45 degrees is acceptable, as is a 0.9 D ellipse at an angle of about 5 to about 10 degrees.

As can be seen in FIG. 2, each of the rows 41, 43, 45, 47, and 49 of linear tubes 22 embodies either a first or a second alternate orientation, sometimes referred to herein as a "rick-rack" arrangement. In this arrangement, the major axis of the elliptical cross-section of each linear tube in each first alternating row 41, 45, and 49 is oriented in a clockwise-rotated position, when viewed along the longitudinal axis of the linear tubes. The clockwise position may encompass an oblique angle a between about 10 and about 45 degrees with respect to a line in the direction of air flow. Preferentially, each linear tube in each first alternating row 41, 45, and 49 is oriented at approximately the same common angle.

Similarly, the major axis of the elliptical cross-section of each linear tube in each second alternating row 43 and 47 is oriented at a counter-clockwise-rotated position. As above, the counter-clockwise position of each linear tube 22 may be at an oblique angle β between about 10 and about 45 degrees with respect to a line in the direction of air flow. Also preferably, each linear tube in each second alternating row 43 and 47 is oriented at approximately the same common angle. Even more preferably, the common angle of the first alternating rows 41, 45, and 49 is approximately equivalent in numerical value to the common angle of the second alternating rows 43 and 47.

In a preferred embodiment of the present invention, the angle of the major axis of the elliptical cross-section is about 20 to about 30 degrees, the minor axis of the ellipse is about 0.8 times the diameter of a tube having a circular cross-section with a circumference equal to the circumference of the central portion of the linear tube, and the distance between the longitudinal axes of adjacent linear tubes in any row is about 2.25 times the diameter of a tube having a circular cross-section with a circumference equal to the circumference of the central portion of the linear tube.

Also preferably, the linear tubes 22, when viewed along their longitudinal axes, are oriented such that the longitudinal axes are in a staggered, triangular pattern, and most preferably, in an equilateral triangular pattern with respect to at least two adjacent linear tubes. As a result, the end portions 32 of a return tube 28 are capable of interconnecting the end portions 26 of any two adjacent linear tubes 22, regardless of the angle of the major axis of either of the linear tubes 22 with respect to a line in the direction of air flow.

With the linear tube geometry, orientation, and placement as described, the coil assembly 12 and the heat exchanger 10 of the present invention provide an additional benefit in having a "turbulence initiation effect". Previously, it has been shown that with both round and non-angled elliptical tubes, the first rows of tubes contacted by the flowing air operated at lower efficiencies than the rows of tubes downstream in the direction of air flow. Thus, an eight row coil provided more than twice the benefit of a four row coil. By empirical analysis, it has been determined that this "first rows effect" is caused by the lack of turbulence in the air flowing past the first few rows of tubing. However, with the linear tubes 22 of the present invention positioned and oriented in the angled-elliptical geometry, turbulence is initiated much more so in the first rows, and efficient heat transfer at the very first row is effectuated and is maintained throughout all rows in the coil assembly 12.

With the turbulence initiation effect and the more efficient heat transfer of the present invention, the number of rows of the linear tubes 22 may be decreased while still providing similar thermal performance when compared to prior art assemblies having round cross-sectional linear tubes. As a result, the coil assembly 12 of the present invention provides less air resistance, and a lower horsepower fan may be used to achieve a higher heat transfer efficiency.

From the foregoing description, it can be seen that the present invention comprises a heat exchanger coil assembly having improved efficiency. It will be appreciated by those skilled in the art that changes could be made to the embodiments described above without departing from the broad inventive concept thereof. It is understood, therefore, that this invention is not limited to the particular embodiments disclosed, but it is intended to cover all modifications which are within the spirit and scope of the present invention as defined by the appended claims.

We claim:

1. A coil assembly for use in a heat exchanger having air flowing in a predetermined direction, the coil assembly comprising:

a plurality of linear tubes, each linear tube having a longitudinal axis, a central portion and two end portions, the central portion having a generally elliptical cross-section with major and minor axes, the minor axis being about 0.8 times the diameter of a tube having a circular cross-section with a circumference equal to the circumference of the central portion of the linear tube, and the two end portions each having a generally circular cross-section, each linear tube oriented to be generally parallel with respect to every other linear tube and to be generally transversely oriented with respect to a line in the direction of air flow, the air flowing across each linear tube, each linear tube also oriented such that the major axis of the elliptical cross-section resides at an oblique angle with respect to a line in the direction of air flow;

the linear tubes being oriented in a plurality of rows, each row of linear tubes being oriented such that a plane intersects the longitudinal axes of the linear tubes in the row, the plane being generally perpendicular with respect to a line in the direction of air flow, the distance between the longitudinal axes of adjacent linear tubes in each row being about 2.25 times the diameter of a tube having a circular cross-section with a circumference equal to the circumference of the central portion of the linear tube, the plurality of rows comprising first and second alternating rows such that, when viewed along the longitudinal axes of the linear tubes, the major axis of the elliptical cross-section of each linear tube in the first alternating rows is oriented at a clockwise-rotated position, the clockwise position being at an oblique angle of about 25 degrees with respect to a line in the direction of air flow, and the major axis of the elliptical cross-section of each linear tube in the second alternating rows is oriented at a counter-clockwise-rotated position, the counter-clockwise position being at an oblique angle of about 25 degrees with respect to a line in the direction of air flow;

the linear tubes, when viewed along their longitudinal axes, being oriented such that their longitudinal axes are in an equilateral triangular pattern with respect to at least two adjacent linear tubes, whereby end portions of a return tube are capable of interconnecting the end portions of any two adjacent linear tubes;

a plurality of return tubes, each return tube having a body portion and two end portions, the body portion comprising a bend of about 180 degrees and the two end portions each having a generally circular cross-section, each end portion engaging an end portion of a linear tube such that a plurality of linear tubes are interconnected with another to form at least one series of linear tubes, each series of linear tubes having first and second ends for respective connection to an inlet source of an internal heat exchange fluid and an outlet for the internal heat exchange fluid; and a plurality of fins adjacent one another, each fin comprising a generally planar sheet of a heat-conductive material, each fin oriented in a plane generally perpendicular with respect to the longitudinal axes of the linear tubes and generally parallel with respect to a line in the direction of air flow, the sheet having a plurality of holes, the central portion of a linear tube extending through a corresponding hole, each fin securely contacting each linear tube extending therethrough such that heat transfer therebetween is effectuated.

2. The coil assembly as recited in claim 1 wherein each end portion of one of the tubes selected from the group consisting of each linear tube and each return tube comprises a round female socket, and wherein the end portion of the other of the tubes selected from the group consisting of each linear tube and each return tube fits into the round female socket.

3. The coil assembly as recited in claim 2 wherein each end portion of each linear tube comprises a round female socket, and wherein the end portion of each return tube fits into the round female socket.

4. The coil assembly as recited in claim 1 wherein each fin further comprises a plurality of major corrugations having a major amplitude and a major period and a plurality of minor corrugations having a minor amplitude and a minor period, the major corrugations defined by a plurality of generally parallel alternating major folds across each fin, the major folds providing major corrugations with the major amplitude relatively small when compared to the major period, each major fold being generally transversely oriented with respect to a line in the direction of air flow, and the minor corrugations defined by a plurality of generally parallel alternating minor folds, the minor folds providing minor corrugations with the minor amplitude relatively small when compared to the minor period, the minor corrugations being oriented along at least a portion of at least one edge of the fin, the edge being generally transversely oriented with respect to a line in the direction of air flow and each minor fold being generally perpendicularly oriented with respect to the edge.

5. The coil assembly as recited in claim 1 wherein each fin further comprises at least one collar extending from around the perimeter of a fin hole in a direction generally perpendicular with respect to the plane of the fin sheet, each collar securely engaging the linear tube extending therethrough, each collar spacing each fin about 0.16 to about 0.33 inch (about 4.1 to about 8.4 mm) apart, and at least one spacing tab extending from the collar in a direction generally parallel with respect to the plane of the fin sheet and away from the fin hole, the spacing tab on a first fin for contacting an adjacent fin and preventing the adjacent fin sheet from moving into contact with the first fin sheet.

6. The coil assembly as recited in claim 1 wherein the fin sheet has a planar area surrounding each hole.

7. A heat exchanger comprising:

a housing;

a blower arranged to cause air to flow through the housing in a predetermined direction;

inlet and outlet manifolds; and a coil assembly at least partially disposed within the housing, the coil assembly comprising:

a plurality of linear tubes, each linear tube having a longitudinal axis, a central portion, and two end portions, the central portion having a generally elliptical cross-section with major and minor axes, the minor axis being about 0.8 times the diameter of a tube having a circular cross-section with a circumference equal to the circumference of the central portion of the linear tube, and the two end portions each having a generally circular cross-section, each linear tube oriented to be generally parallel with respect to every other linear tube and to be generally transversely oriented with respect to a line in the direction of air flow, the air flowing across each linear tube, each linear tube also oriented such that the major axis of the elliptical cross-section resides at an oblique angle with respect to a line in the direction of air flow;

the linear tubes being oriented in a plurality of rows, each row of linear tubes being oriented such that a plane intersects the longitudinal axes of the linear tubes in the row, the plane being generally perpendicular with respect to a line in the direction of air flow, the distance between the longitudinal axes of adjacent linear tubes in each row being about 2.25 times the diameter of a tube having a circular cross-section with a circumference equal to the circumference of the central portion of the linear tube, the plurality of rows comprising first and second alternating rows such that, when viewed along the longitudinal axes of the linear tubes, the major axis of the elliptical cross-section of each linear tube in the first alternating rows is oriented at a clockwise-rotated position, the clockwise position being at an oblique angle of about 25 degrees with respect to a line in the direction of air flow, and the major axis of the elliptical cross-section of each linear tube in the second alternating rows is oriented at a counter-clockwise-rotated position, the counter-clockwise position being at an oblique angle of about 25 degrees with respect to a line in the direction of air flow;

the linear tubes, when viewed along their longitudinal axes, being oriented such that their longitudinal axes are in an equilateral triangular pattern with respect to at least two adjacent linear tubes, whereby end portions of a return tube are capable of interconnecting the end portions of any two adjacent linear tubes;

a plurality of return tubes, each return tube having a body portion and two end portions, the body portion comprising a bend of about 180 degrees and the two end portions each having a generally circular cross-section, each end portion engaging an end portion of a linear tube such that a plurality of linear tubes are interconnected to form at least one series of linear tubes, each series of linear tubes having first and second ends, each series of linear tubes interconnected at the first end to the inlet manifold and at the second end to the outlet manifold, wherein an internal heat exchange fluid is circulated through the inlet manifold, the coil assembly, and then the outlet manifold such that heat is exchanged between the air flowing across each linear tube and the internal heat exchange fluid; and a plurality of fins disposed within the housing adjacent one another, each fin comprising a generally planar sheet of a heat-conductive material, each fin oriented in a plane generally perpendicular with respect to the longitudinal axes of the linear tubes and generally parallel with respect to a line in the direction of air flow, the sheet having a plurality of holes, the central portion of a linear tube extending through a corresponding hole, each fin securely contacting each linear tube extending therethrough such that heat transfer therebetween is effectuated, the fins enhancing the heat exchange between the flowing air and the internal heat exchange fluid.

8. The heat exchanger as recited in claim 7 wherein each end portion of one of the tubes selected from the group consisting of each linear tube and each return tube comprises a round female socket, and wherein the end portion of the other of the tubes selected from the group consisting of each linear tube and each return tube fits into the round female socket.

9. The heat exchanger as recited in claim 8 wherein each end portion of each linear tube comprises a round female socket, and wherein the end portion of each return tube fits into the round female socket.

10. The heat exchanger as recited in claim 7 wherein each fin further comprises a plurality of major corrugations having a major amplitude and a major period and a plurality of minor corrugations having a minor amplitude and a minor period, the major corrugations defined by a plurality of generally parallel alternating major folds across each fin, the major folds providing major corrugations with the major amplitude relatively small when compared to the major period, each major fold being generally transversely oriented with respect to a line in the direction of air flow, and the minor corrugations defined by a plurality of generally parallel alternating minor folds, the minor folds providing minor corrugations with the minor amplitude relatively small when compared to the minor period, the minor corrugations being oriented along at least a portion of at least one edge of the fin, the edge being generally transversely oriented with respect to a line in the direction of air flow and each minor fold being generally perpendicularly oriented with respect to the edge.

11. The heat exchanger as recited in claim 7 wherein each fin further comprises at least one collar extending from around the perimeter of a fin hole in a direction generally perpendicular with respect to the plane of the fin sheet, each collar securely engaging the linear tube extending therethrough, each collar spacing each fin about 0.16 to about 0.33 inch (about 4.1 to about 8.4 mm) apart, and at least one spacing tab extending from the collar in a direction generally parallel with respect to the plane of the fin sheet and away from the fin hole, the spacing tab on a first fin for contacting an adjacent fin and preventing the adjacent fin sheet from moving into contact with the first fin sheet.

12. The heat exchanger as recited in claim 7 wherein the fin sheet has a planar area surrounding each hole.

* * * * *